313-428 SR
2/19/80 XR 4,189,659

United States Patent [19]
Andre et al.

[11] 4,189,659
[45] Feb. 19, 1980

[54] COLOR-TELEVISION PICTURE TUBE WITH INTERNAL PERMANENT MAGNETS FOR CONVERGENCE CORRECTION

[75] Inventors: Wolfram Andre; Hans Müller, both of Aichwald, Fed. Rep. of Germany

[73] Assignee: International Standard Electric Corporation, New York, N.Y.

[21] Appl. No.: 905,663

[22] Filed: May 15, 1978

[30] Foreign Application Priority Data

May 18, 1977 [DE] Fed. Rep. of Germany ..... 2722477

[51] Int. Cl.[2] ..... H01J 29/76; H01J 31/20

[52] U.S. Cl. ..... 313/412; 313/428; 335/210; 29/25.17

[58] Field of Search ..... 313/412, 411, 413, 409, 313/431, 428, 414

[56] References Cited

U.S. PATENT DOCUMENTS

| | | | |
|---|---|---|---|
| 2,907,915 | 10/1959 | Gleichauf | 313/412 X |
| 3,217,200 | 11/1965 | Gethmann | 313/443 |
| 3,363,127 | 1/1968 | Rennick | 313/412 |
| 3,866,080 | 2/1975 | Barkow | 313/412 |

*Primary Examiner*—Robert Segal
*Attorney, Agent, or Firm*—John T. O'Halloran; Alfred C. Hill

[57] ABSTRACT

An in-line color-television picture tube wherein purity adjustment, vertical pincushion correction, and static convergence correction are performed by magnetic fields produced by permanent magnets acting on the beams.

5 Claims, 15 Drawing Figures

COLOR-TELEVISION PICTURE TUBE WITH INTERNAL PERMANENT MAGNETS FOR CONVERGENCE CORRECTION

BACKGROUND OF THE INVENTION

The invention relates generally to color-television picture tubes and in particular to an improved and novel picture tube wherein purity adjustment, vertical pincushion correction, and static convergence correction are performed by magnetic fields produced by permanent magnets acting on the beams.

Such adjusting and correcting devices provided with permanent magnets are slipped over the tube neck and locked there. They consist of rotatable pairs of magnetic rings, it being possible to change the field strength by rotating the rings of a pair against each other, and the field direction by rotating the pair. Such a device is described in a data sheet entitled "VALVO-Ablenkteile: Mehrpoleinheit DT 10 81", December 1973. The adjustment is effected by means of plastic gears and pinions, and since four pairs of magnetic rings have to be adjusted, a relatively expensive unit is obtained which is needed virtually only in the event of a tube change. Other prior art aspects of color-television picture tubes are shown in German prior art DT-OS No. 22 49 474 and DT-OS No. 24 08 994.

SUMMARY OF THE INVENTION

The object of the present invention is to reduce the cost of these adjusting and correcting devices in a color-picture tube to a minimum, avoiding, as far as possible, any complicated adjusting gear and associated locking mechanisms against unintentional adjustment. The advantage is seen in the fact that the adjusting and correcting means assigned to the tube during manufacture and remaining with the tube consist of only eight small, magnetizable, hard magnetic pieces which are disposed within the tube neck. The magnetization is required only for the adjustment and correction during the manufacture of the tube, so the cost involved is negligible in view of the large number of tubes to be aligned.

DESCRIPTION OF THE PREFERRED EMBODIMENT

Figure 1:
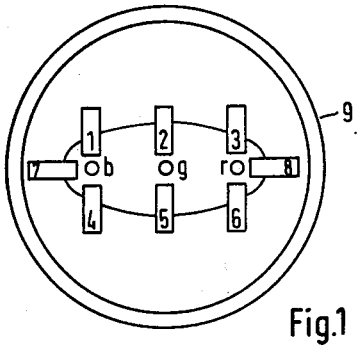
FIG. 1 is a section through the neck of a color-picture tube above the cathode plane with the adjusting and correcting magnets according to the invention.

Referring to FIG. 1, the tubular part of glass forming the tube neck is designated 9. Mounted within an electrode common to all three electron guns and about the openings b, g and r for the cathode rays irradiating the blue, green and red phosphors of the screen are permanent magnets 1 to 8 which are associated with the three electron beams as shown in FIGS. 3 to 8. These magnets may be, for example, hard magnetic lengths of wire joined to the electrode material by spot welding, for example, or they may be hard magnetic ferrite pieces.

Figure 2:
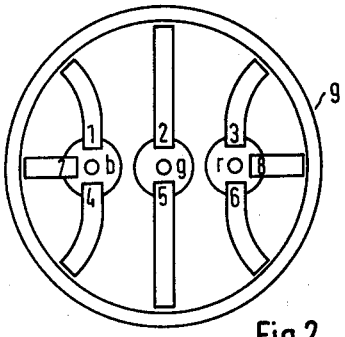
FIG. 2 shows the section of FIG. 1 but with different magnet shapes.

The sectional view of FIG. 2 shows within the tube neck 9 three individual electron guns with openings b, g, and r for the electron beams irradiating the blue, green, and red phosphors, respectively. Here, too, the magnets 1 to 8 are provided, whose action is apparent from FIGS. 3 to 8 and which are so shaped here that the permanent flux can be changed from outside by remagnetization. To this end, the magnets 1 to 8 may be of suitable shape as a whole, but it is also possible to simply provide the bar magnets 1 to 8 of FIG. 1 with suitable pole pieces. The exact shape is dependent on the design of the picture tube.

FIGS. 3 to 8 show how the desired static correction can be achieved by permanent excitation of individual ones of the magnets 1 to 8. FIGS. 3*a* and 3*b* show how horizontal purity adjustment is performed by permanent excitation of the magnets 1 to 6. FIGS. 4*a* and 4*b* show how to carry out red/green vertical static convergence correction by permanent magnetization of the magnets 2, 5, and 8, while FIGS. 5*a* and 5*b* show the red/green horizontal static convergence correction by means of the magnets 3 and 6. Similarly, FIGS. 6*a, b,* and 7*a, b* show how blue/green vertical and horizontal static convergence correction is performed by means of the magnets 2, 5, 7 and 1, 4, respectively. FIGS. 8*a* and 8*b* show how vertical pincushion correction can be performed by means of the magnets 7 and 8.

Figure 9:
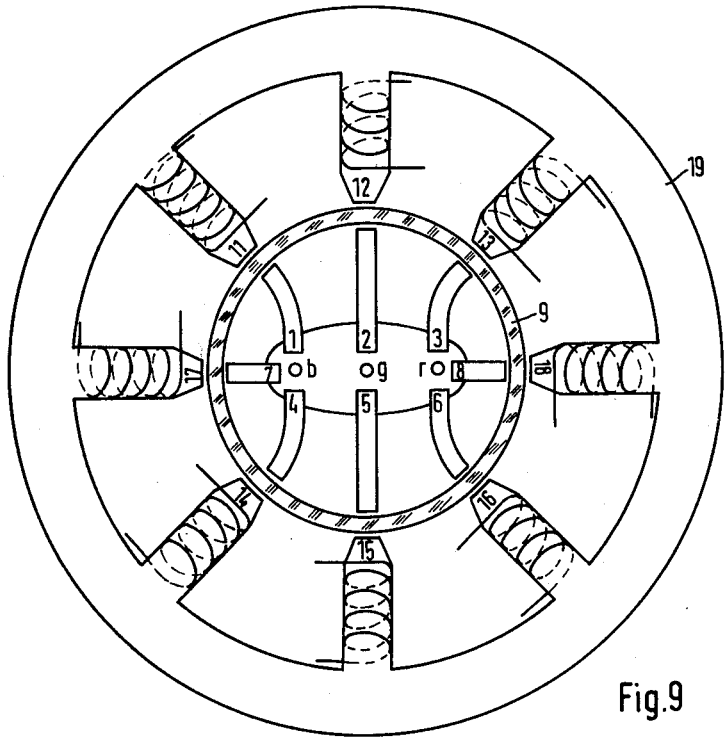
FIG. 9 shows the section of FIG. 2 with a magnetizing yoke slipped over the tube neck, the yoke serving to adjust the permanent flux in the magnets.
Figure 3A:
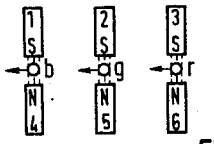
FIGS. 3*a* and 3*b* show the necessary permanent excitation of the magnets for horizontal purity adjustment.
Figure 3B:
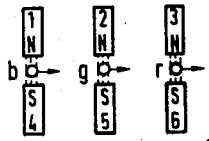
Figure 4A:
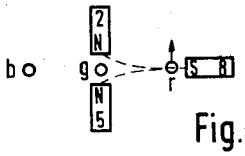
FIGS. 4*a* and 4*b* show the necessary permanent excitation of the magnets for vertical static convergence correction.
Figure 4B:
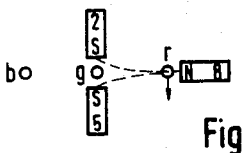
Figure 5A:
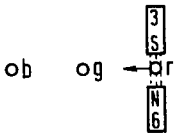
FIGS. 5*a* and 5*b* show the necessary permanent excitation of the magnets for red/green horizontal static convergence correction.
Figure 5B:
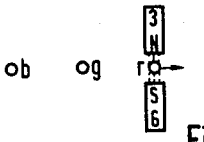
Figure 6A:
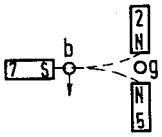
FIGS. 6*a* and 6*b* show the necessary permanent excitation of the magnets for blue/green vertical static convergence correction.
Figure 6B:
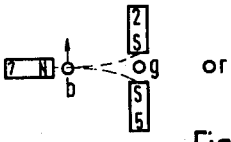
Figure 7A:
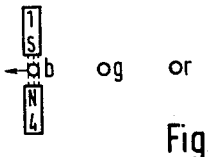
FIGS. 7*a* and 7*b* show the necessary permanent excitation of the magnets for blue/green horizontal static convergence correction.
Figure 7B:
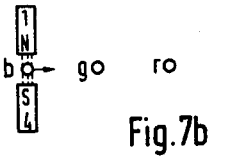
Figure 8A:
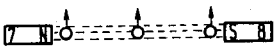
FIGS. 8*a* and 8*b* show the necessary permanent excitation of the magnets for vertical pincushion correction.
Figure 8B:
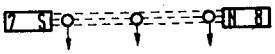

FIG. 9 shows a magnetizing yoke 19 which can be slipped over the tube neck and with which the permanent flux in the magnets 1 to 8 can be adjusted to the desired value. Those poles of the magnets 1 to 8 which face the tube neck 9 are assigned electromagnetically excitable pole pieces 11 to 18 provided at the magnetizing yoke. In designing this magnetizing yoke, care must be taken to ensure that the reluctnace of the outer ring interconnecting all pole pieces 11 to 18 is very low compared to the reluctance of the pole pieces 11 to 18 and of the other parts of the magnetic circuit, such as of the magnets 1 to 8 and the intervening air gap, so as to prevent any coupling among the pole pieces whereby other magnetic paths would be unintentionally permanently excited.

For the present invention, it makes no difference whether the permanent excitation is effected by a single excitation of the associated poles or by magnetization in small steps as is done in a magnetic storage element and mostly in a transfluxor. In the first case, the currents in the windings about the poles can be slowly increased until sufficient alignment has been achieved by means of this separately excited flux. The current is then increased by a predetermined value for a short time so that after the current has been turned off, the alignment value remains as a permanent flux. It should be pointed out that the alignment must be performed in the direction of flux increase. In the opposite direction, the hitherto caused permanent magnetization must first be removed before readjustment is performed. This can be avoided with a step-by-step adjustment, for which several possibilities are known. For instance, the setting winding may be fed with pulses of relatively high voltage but short duration which, because of their short duration, each cause only a slight increase in the magnetization of the hard magnetic core. It is also possible, however, to impress a current on the setting winding and interrupt it immediately or after a predetermined time when flux impression takes place at the transition from the reversible to the irreversible branch. For these methods, the teachings of German Pat. Nos. 1,109,735, 1,112,109, 1,125,483, 1,128,518, 1,168,959, and 1,248,718 can be used analogously. The advantage of the step-by-step adjustment is that even a reduction of the impressed permanent flux can be obtained in equal, small steps without cancelling the adjustment.

We claim:

1. In an in-line color-television picture tube having a neck portion including therein three coplanar electron guns generating three separate electron beams for irradiating blue, green and red phosphors on a screen wherein purity adjustment, vertical pincushion correction and static convergence correction are performed by magnetic fields acting on said beams, the improvement comprising:

a plurality of permanent magnets disposed within said tube neck adjacent the output of said electron guns for making the above-mentioned adjustment and corrections, said plurality of permanent magnets consisting of a first pair of bar-like permanent magnets disposed adjacent each of said electron beams, the permanent magnets of each of said first pair of magnets having their poles on the ends thereof and extend outward from said plane of said electron guns in opposite directions with respect to each other, and a second pair of bar-like permanent magnets disposed in said plane of said electron guns, the permanent magnets of said second pair of magnets having their poles on the ends thereof, one of said second pair of magnets being disposed adjacent one of the outer ones of said electron guns and the other of said second pair of magnets being disposed adjacent the other of the outer ones of said electron guns.

2. The picture tube of claim 1, wherein each of said plurality of magnets is a hard magnetizable magnetic piece of material.

3. The picture tube of claim 1, wherein each of said electron guns has associated therewith an electrode which is connected to an associated one of said plurality of magnets constructed of hard magnetic links of wire.

4. The picture tube of claim 1, wherein each of said electron guns has associated therwith an electrode which is connected to an associated one of said plurality of magnets constructed of hard magnetic ferrite pieces of material.

5. The picture tube of claim 1, wherein said neck portion is adapted to receive externally thereof during manufacture of said tube a magnetizing yoke having individual pole pieces with windings that are positioned adjacent to one end of each of said plurality of permanent magnets, whereby the necessary permanent flux in the individual ones of said plurality of magnets may be excited with respect to the polarization and exciting current strength applied to the windings so that the necessary permanent flux remains in the individual ones of said plurality of permanent magnets for improved operation of said tube after said magnetizing yoke is removed.

* * * * *